United States Patent [19]

Kabilka et al.

[11] Patent Number: 4,843,972

[45] Date of Patent: Jul. 4, 1989

[54] APPARATUS FOR VERTICAL ADJUSTMENT OF A TRAVELING SERVICE UNIT FOR A TEXTILE SPINNING MILL MACHINE

[75] Inventors: Otto Kabilka, Munich; Otto Weich, Schlangenhofen; Herbert Grassle, Schwabisch; Hans-Peter Weeger, Hattenhofen, all of Fed. Rep. of Germany

[73] Assignee: Zinser Textilmaschinen GmbH, Fed. Rep. of Germany

[21] Appl. No.: 128,365

[22] Filed: Dec. 3, 1987

[51] Int. Cl.[4] ..... B60S 9/08

[52] U.S. Cl. ..... 104/296; 104/244.1; 104/284; 104/119; 104/123; 280/6.1; 280/43.2; 280/43.21

[58] Field of Search ..... 104/242, 248, 244.1, 104/245, 304, 284, 296, 243, 119, 123; 105/164, 82, 29.1, 87, 88; 180/168; 280/6.1, 43.2, 43.21, 6 R, 6 H, 6.1

[56] References Cited

U.S. PATENT DOCUMENTS

| | | | |
|---|---|---|---|
| 2,568,402 | 9/1951 | Lynn | 105/164 |
| 3,530,798 | 9/1970 | Faure | 104/119 |
| 3,707,926 | 1/1973 | Ellzey | 104/243 |
| 3,881,426 | 5/1975 | Long | 105/28 |
| 4,138,072 | 2/1979 | Aoyama et al. | 242/41 |
| 4,235,454 | 11/1980 | Gray et al. | 280/43.2 |
| 4,366,756 | 1/1983 | Brum | 104/244.1 |
| 4,611,815 | 9/1986 | Sasage et al. | 280/6 H |
| 4,611,816 | 9/1986 | Traister et al. | 280/43.2 |

FOREIGN PATENT DOCUMENTS

| | | | |
|---|---|---|---|
| 1213770 | 9/1966 | Fed. Rep. of Germany . | |
| 1535025 | 4/1970 | Fed. Rep. of Germany . | |
| 1510626 | 6/1971 | Fed. Rep. of Germany . | |
| 2019370 | 11/1971 | Fed. Rep. of Germany . | |
| 2460376 | 6/1976 | Fed. Rep. of Germany . | |
| 2516004 | 10/1976 | Fed. Rep. of Germany . | |
| 2802805 | 8/1978 | Fed. Rep. of Germany . | |
| 0246789 | 4/1926 | Italy | 280/43.2 |
| 0647369 | 10/1962 | Italy | 280/43.2 |
| 0023807 | 1/1987 | Japan | 280/6.1 |

*Primary Examiner*—Andres Kashnikow
*Assistant Examiner*—Mark T. Le
*Attorney, Agent, or Firm*—Shefte, Pinckney & Sawyer

[57] ABSTRACT

A traveling service unit for an associated textile spinning mill machine may be elevationally adjusted with respect to a reference rail mounted longitudinally along the machine by a feeler guide element pivotably mounted to the service unit in following engagement to the reference guide rail in conjunction with an operatively associated controller connected with vertically adjustable roller support assemblies of the service unit 1 for varying the elevation of the service unit 1 as necessary to compensate for deviations in the pivotal disposition of the feeler guide element with respect to horizontal.

9 Claims, 1 Drawing Sheet

APPARATUS FOR VERTICAL ADJUSTMENT OF A TRAVELING SERVICE UNIT FOR A TEXTILE SPINNING MILL MACHINE

BACKGROUND OF THE INVENTION

The present invention relates to an apparatus for elevational adjustment of a traveling service unit vertically with respect to an associated textile machine in a textile spinning mill and, more particularly, to an apparatus of the aforementioned type for vertically adjusting a traveling service unit with respect to a longitudinal guide rail along the spinning mill machine on which the service unit is guided by at least one guide element.

Traveling service units of the aforementioned type are commonly operated in association with various machines in textile spinning mills for performing automatic servicing functions thereon, such as the doffing and donning of bobbins and the piecing of broken yarn ends. In order for such service units to function reliably, the units must be precisely adjusted in elevation with respect to the associated spinning mill machine.

In this regard, it has been suggested in the prior art that elevational adjustment of traveling service units with respect to the associated textile machine may be achieved by guiding the service unit along a supporting rail which is mounted to the associated machine in precise relative adjustment thereto. However, in this arrangement, the entire weight of the traveling service unit, which often is considerable, must be supported by the machine. For this reason, the framework of such textile machines must be suitably reinforced, but nevertheless the machine framework undergoes detrimental deformation during traveling movement of the service unit.

It has also been suggested in the prior art to provide the traveling service unit with floor-supporting rollers to transfer at least a portion of the weight of the service unit to the supporting floor with only the remaining portion of the weight of the service unit being required to be supported by the guide rail of the spinning mill machine. Hereagain, however, the frame of the spinning mill machine is still required to support a considerable portion of the weight of the traveling service unit.

SUMMARY OF THE INVENTION

It is accordingly an object of the present invention to provide an apparatus for precise elevational adjustment of a traveling service unit in relation to an associated textile spinning mill machine without placing any significant load on the machine framework.

The aforestated objective is satisfied by the present invention by utilizing a guide rail arranged as an elevational reference longitudinally along the associated textile spinning machine and a guide element arranged as a feeler for engagement with the reference guide rail for guiding the traveling service unit therealong. Suitable means are provided in association with the feeler guide element for controlling elevational adjustment of the traveling service unit in relation to the reference guide rail.

Preferably, the feeler guide element comprises a lever arm pivotably mounted at one end of the traveling service unit about a horizontal pivot axis and being guided at the opposite end along the reference guide rail. The controlling means includes an inclination detector, e.g., an electronic level detector, operatively connected to the lever arm for detecting the angular relationship thereof to horizontal and for producing a corresponding control signal for vertical adjustment of the traveling service unit. The feeler guide element is preferably disposed in an operating area of the traveling service unit whereat the operational service components thereof are positioned. A control element is operatively associated with the feeler guide element for detecting the elevation of the traveling service unit and for deactuating it when a predetermined elevation tolerance range is exceeded.

The traveling service unit is supported on a floor surface by a suitable supporting means which is selectively adjustable for varying the elevation of the traveling service unit with respect to the floor surface. The supporting means includes a plurality of roller assemblies mounted to the traveling service unit for rolling floor engagement, each roller assembly being adjustable vertically relative to the traveling service unit. The roller assemblies may be independently mounted to the service unit or may be mounted in tandem to an undercarriage associated with the service unit.

DESCRIPTION OF THE PREFERRED EMBODIMENT

Figure 1:
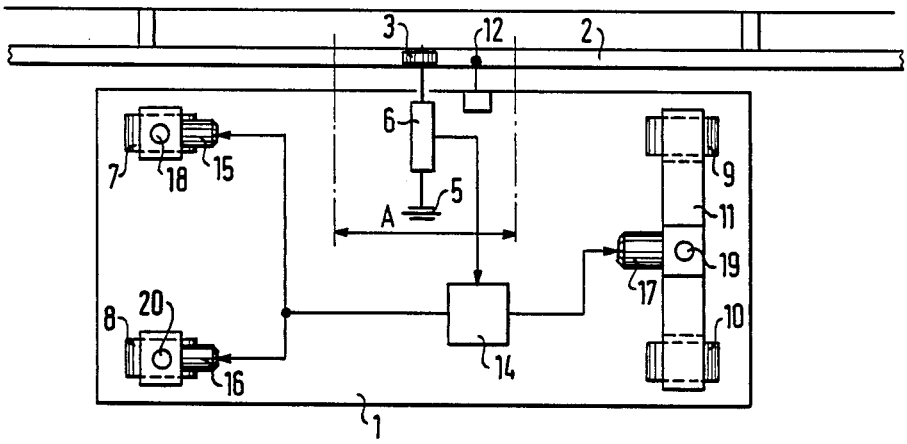
FIG. 1 is a schematic plan view of a traveling service unit embodying one preferred embodiment of the elevational adjustment apparatus according to the present invention.
Figure 2:
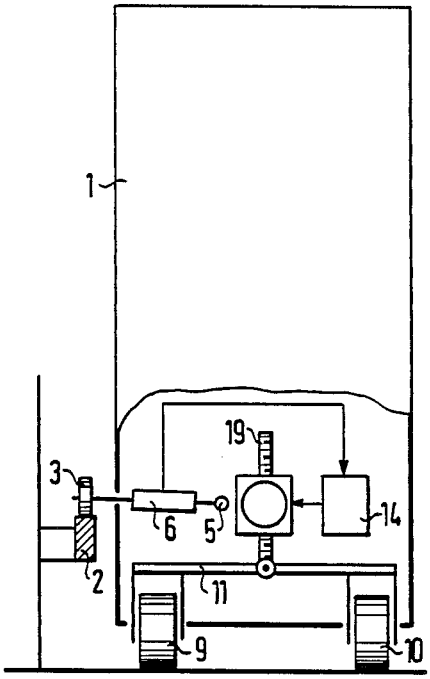
FIG. 2 is a schematic end elevational view, partially broken-away, of the traveling service unit of FIG. 1.

Referring now to the accompanying drawings and initially to FIGS. 1 and 2, a traveling service unit of the basic aforedescribed type to which the present invention relates is representatively illustrated schematically at 1. As described, the service unit 1 is adapted for traveling movement longitudinally along an associated textile machine (not shown) such as in a textile spinning mill for performing servicing operations thereon. While the associated textile machine is not depicted, a guide rail is shown at 2 as would be mounted in accordance with the present invention longitudinally along the associated textile machine as an elevational reference.

As seen in FIG. 1, the traveling service unit 1 is mounted on four supporting roller wheel assemblies 7,8,9,10 for rolling floor engagement to support the unit 1 for its traveling movement. Each of the supporting roller assemblies 7,8 includes an upstanding screw spindle 18,20 with a supporting wheel rotatably mounted to the lower end thereof and with the upstanding extent of the spindle 18,20 threadedly engaged with an annular nut mounted within the housing of the traveling service unit 1. Each nut associated with the screw spindles 18,20 is drivenly associated with a respective control motor 15,16 for rotational operation of the nuts relative to the screw spindles 18,20, thereby facilitating vertical adjustment of the roller supporting assemblies 7,8 relative to the traveling service unit 1. In similar manner, the supporting roller assemblies 9,10 are mounted in tandem to an undercarriage 11 to which an upstanding screw spindle 19 is affixed in threaded engagement with an associated nut mounted within the traveling service unit 1 in driven association with a control motor 17 for similar vertical adjustment of the roller assemblies 9,10 relative to the service unit 1. Of course, as those persons skilled in the art will readily recognize, many other alternative constructions may be utilized to facilitate selective raising and lowering of the elevation of the traveling service unit 1 with respect to the reference rail 2. For example, each of the four supporting roller assemblies 7,8,9,10 may be individually mounted to the service unit 1, or the roller assemblies 7,8 may be mounted in tandem to an undercarriage similar to the roller assemblies 9,10. Further, hydraulic or pneumatic operating elements, articulated mechanical systems, and other mechanical components and arrangements may likewise be utilized in substitution for the spindle and nut-type assemblies shown.

A feeler guide element 3 includes a lever arm pivotably mounted at one end thereof to the traveling service unit 1 about a horizontal pivot axis 5 with the opposite extending end of the lever arm carrying a feeler roller for engagement with the guide rail 2 for guiding the traveling service unit 1 therealong. An electronic level 6 is rigidly mounted to the feeler element 3 for sensing the angular relationship of the feeler element 3 with respect to horizontal. The electronic level detector 6 is operatively connected with each of the control motors 15,16,17 through a common controller 14 for actuating operation of the motors 15,16,17 in relation to the angular disposition of the feeler element 3 relative to horizontal as sensed by the level detector 6. Preferably, the electronic level 6 is disposed in the area of the traveling service unit 1 wherein the operating service components (not shown) of the service unit 1 are located, as represented by the area A in FIG. 1, whereat the elevation of the service unit 1 is desired to be maintained most precisely.

In operation, the electronic level detector 6 monitors the angular relationship of the feeler guide element 3 to horizontal, as a reflection of the elevation of the traveling service unit 1 with respect to the elevation reference rail. In turn, the level detector 6 produces a measurement signal indicating the angular disposition of the feeler guide element 3 and transmits the measurement signal to the controller 14 which is programmed, in turn, to control operation of the control motors 15,16,17 in relation to the measurement signal to correspondingly adjust the elevation of the traveling service unit upwardly and downwardly with respect to the reference rail 2 to compensate for deviations in the relative horizontal disposition of the feeler guide element 3 to maintain its measurement signal output at a predetermined zero value.

Preferably, a control switch 12 is provided in operative association with the feeler guide element 3 in close is disposition thereto to monitor the elevation of the traveling service unit 1 and to de-actuate operation of the service unit 1 if and when the elevation exceeds a predetermined tolerance range.

Figure 3:
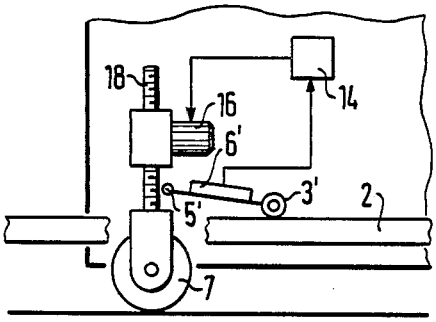
FIG. 3 is a schematic broken-away side elevational view of a traveling service unit according to another embodiment of the present invention.

With reference now to FIG. 3, an alternative embodiment of the present invention is shown wherein the feeler guide element 3' and its associated electronic level detector 6' are pivotably mounted about an axis 5' which is arranged diagonally with respect to the elevation reference rail 2. As in the embodiment of FIGS. 1 and 2, operational control of the motors associated with the supporting roller assemblies, 7,8,9,10 is provided by a common controller 14 operatively associated with the level detector 6' and each motor, only the motor 16 and the supporting roller assembly 7 and its screw spindle 8 being shown in FIG. 3. This arrangement provides an equally simple means for achieving precise elevational adjustment of the traveling service unit 1 with respect to the textile spinning mill machine.

Figure 4:
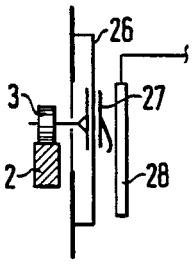
FIG. 4 is a schematic view of an alternative embodiment of feeler guide element according to the present invention.

While electronic level detectors 6,6' are utilized in the embodiments shown in FIGS. 1–3, a slide-type detector as shown in FIG. 4 may alternatively be utilized. With this type of detector, the feeler guide element 3 is mounted to a slide member 27 slidably disposed on a guide rod 26, with the slide member 27 acting as a ground pick-up in association with a potentiometer 28. The potentiometer 28 generates and transmits an electrical signal to the controller 14 for operating as necessary the drive motors to the supporting roller assemblies 7,8,9,10, thereby for controlling the elevational adjustment of the traveling service unit 1.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In combination, a textile spinning mill machine, a service unit for traveling movement along said spinning mill machine for performing servicing operations thereon, and apparatus for vertical adjustment of said traveling service unit with respect to said spinning mill machine, said adjustment apparatus comprising a guide rail arranged as an elevation reference longitudinally along the textile spinning mill machine in a predetermined relationship thereto, a feeler guide element arranged for engagement with said reference guide rail for guiding the traveling service unit therealong, and means associated with said feeler guide element for controlling elevational adjustment of said traveling service unit in relation to said reference guide rail.

2. The combination according to claim 1 and characterized further in that said feeler guide element comprises a lever arm pivotably mounted at one end to said traveling service unit about a horizontal pivot axis and being guided at the opposite end of said lever arm along said reference guide rail for vertical adjustment of said traveling service unit in relation to the angular relationship of said level arm to horizontal.

3. The combination according to claim 2 and characterized further in that said controlling means comprises an inclination detector operatively connected to said lever arm for detecting the angular relationship thereof to horizontal and for producing a corresponding control signal for vertical adjustment of the traveling service unit.

4. The combination according to claim 3 and characterized further in that said inclination detector comprises an electronic level detector.

5. The combination according to claim 1 and characterized further by a means for supporting the traveling service unit on a floor surface and being selectively adjustable for adjusting the elevation of the traveling service unit with respect to the floor surface.

6. The combination according to claim 5 and characterized further in that said supporting means includes a plurality of roller assemblies mounted to the traveling service unit for rolling floor engagement, each roller assembly being adjustable vertically relative to the traveling service unit.

7. The combination according to claim 5 and characterized further in that said supporting means comprises a plurality of support assemblies for the traveling service unit, each support assembly being adjustable vertically relative to the traveling service unit, one support assembly being mounted to an undercarriage associated with the traveling service unit.

8. The combination according to claim 1 and characterized further in that said feeler guide element is disposed in an operating area of the traveling service unit having operational service components thereof.

9. The combination according to claim 1 and characterized further by a control element operatively associated with said feeler guide element for detecting the elevation of the traveling service unit and for deactuating it when a predetermined elevation tolerance range is exceeded.

* * * * *